US012722748B2

(12) United States Patent
Velev

(10) Patent No.: US 12,722,748 B2
(45) Date of Patent: Sep. 1, 2026

(54) WATER VEHICLE

(71) Applicant: CPD LTD., Sofia (BG)

(72) Inventor: Ivaylo Emilov Velev, Sofia (BG)

(73) Assignee: CPD LTD., Sofia (BG)

( * ) Notice: Subject to any disclaimer, the term of this patent is extended or adjusted under 35 U.S.C. 154(b) by 627 days.

(21) Appl. No.: 18/267,399

(22) PCT Filed: Dec. 14, 2021

(86) PCT No.: PCT/IB2021/061710
§ 371 (c)(1),
(2) Date: Jun. 14, 2023

(87) PCT Pub. No.: WO2022/130204
PCT Pub. Date: Jun. 23, 2022

(65) Prior Publication Data

US 2024/0051643 A1 Feb. 15, 2024

(30) Foreign Application Priority Data

Dec. 17, 2020 (EP) ..... 20472018

(51) Int. Cl.
*B63B 32/10* (2020.01)
*B63B 79/10* (2020.01)
(Continued)

(52) U.S. Cl.
CPC ..... *B63B 32/10* (2020.02); *B63B 79/10* (2020.01); *B63B 79/40* (2020.01); *B63H 5/08* (2013.01);
(Continued)

(58) Field of Classification Search
CPC ..... B63B 32/10; B63B 34/10; B63B 34/15; B63B 34/40
See application file for complete search history.

(56) References Cited

U.S. PATENT DOCUMENTS 2,953,321 A 9/1960 Robertson et al.
9,359,044 B2 6/2016 Langelaan
(Continued)

FOREIGN PATENT DOCUMENTS

CN 106741785 A 5/2017
CN 106882341 A * 6/2017 ..... B63B 34/10
(Continued)

OTHER PUBLICATIONS

International Search Report and Written Opinion of the International Searching Authority for Application No. PCT/IB2021/061710, dated Mar. 22, 2022.

*Primary Examiner* — Andrew Polay
(74) *Attorney, Agent, or Firm* — MARSHALL, GERSTEIN & BORUN LLP

(57) ABSTRACT

An autonomous water vehicle for moving above the water surface, part of the device being under water and part being lifted above the water surface. The water vehicle includes an underwater propulsion module, an upper platform and a vertical support, a power source and an electronic control unit. The propulsion module has a housing in which at least two propeller groups are preferably mounted, including electric motors and water screw propellers with two to five blades, such as the propeller groups are arranged symmetrically with respect to the central vertical axis of the housing and are designed to generate vertical thrust for lifting the upper platform plus maximum payload above the water surface. The rotational axes of the propeller groups are arranged vertically or at an angle to the central vertical axis of the housing.

9 Claims, 3 Drawing Sheets

(51) Int. Cl.

| | |
|---|---|
| ***B63B 79/40*** | (2020.01) |
| ***B63H 5/08*** | (2006.01) |
| ***B63H 5/16*** | (2006.01) |
| ***B63H 21/17*** | (2006.01) |
| ***B63H 21/21*** | (2006.01) |

(52) U.S. Cl.
CPC ..... *B63H 5/16* (2013.01); *B63H 21/17* (2013.01); *B63H 21/21* (2013.01); *B63H 2021/216* (2013.01)

(56) References Cited

U.S. PATENT DOCUMENTS

| | | | | |
|---|---|---|---|---|
| 10,358,194 | B1 * | 7/2019 | Wengreen | G05D 1/0206 |
| 2019/0106190 | A1 * | 4/2019 | Schibli | B63H 20/007 |
| 2020/0023971 | A1 | 1/2020 | Duru | |

FOREIGN PATENT DOCUMENTS

| | | | | |
|---|---|---|---|---|
| CN | 106882341 | B | 5/2018 | |
| CN | 209366405 | U | 9/2019 | |
| CN | 111846183 | A | 10/2020 | |
| KR | 101816136 | B1 * | 1/2018 | B63B 49/00 |
| WO | WO-2017105266 | A1 | 6/2017 | |
| WO | WO-2019050570 | A1 * | 3/2019 | B63B 32/10 |
| WO | WO-2019104379 | A1 | 6/2019 | |
| WO | WO-2020176033 | A1 | 9/2020 | |
| WO | WO-2020212664 | A1 | 10/2020 | |

* cited by examiner

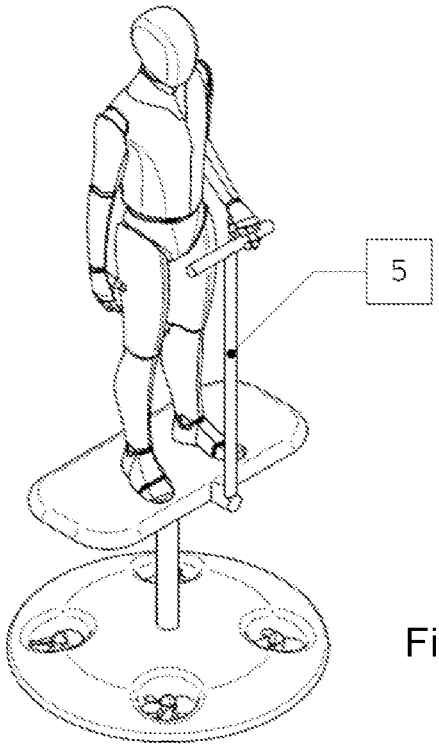
Fig. 4
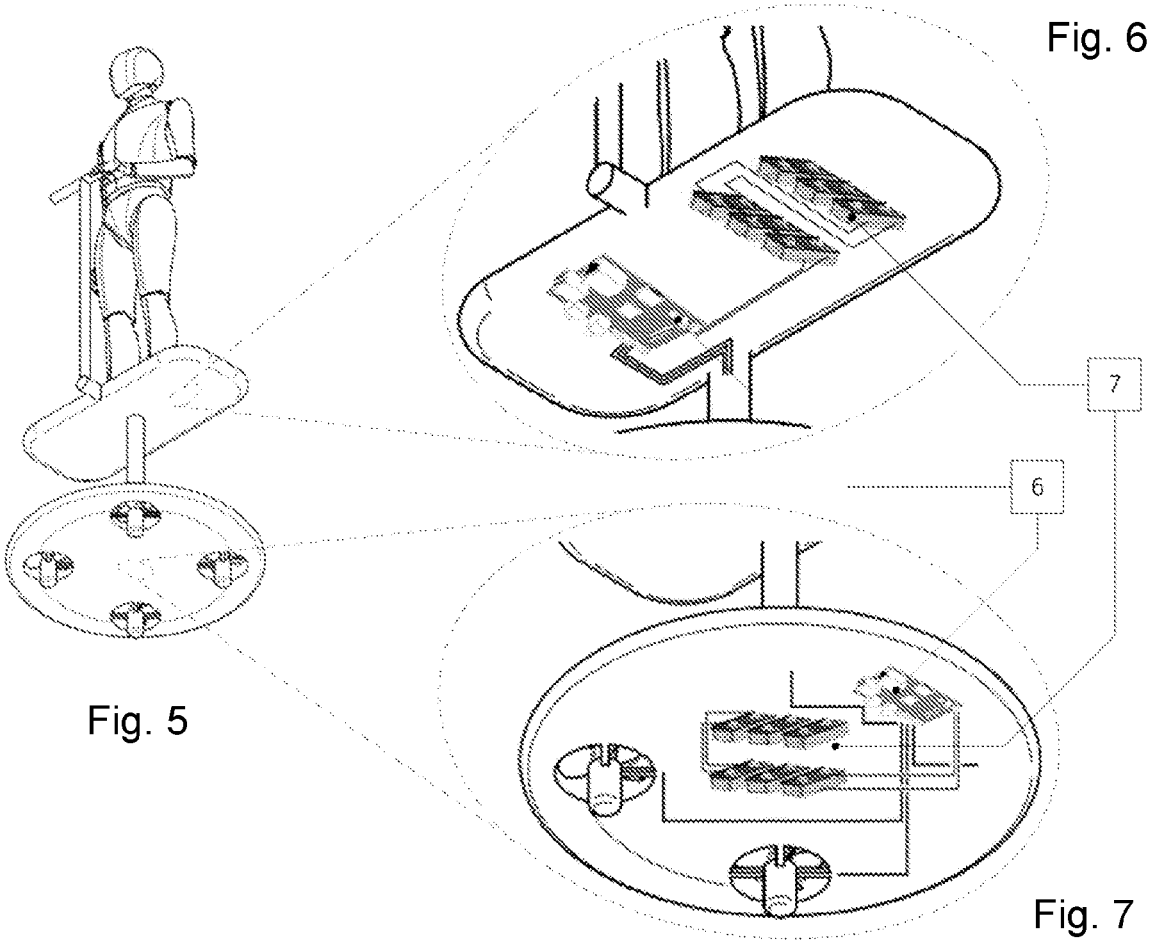
Fig. 6
Fig. 5
Fig. 7

WATER VEHICLE

CROSS-REFERENCE TO RELATED APPLICATION

The present application is the US national phase of International Patent Application No. PCT/IB2021/061710, filed Dec. 14, 2021, which claims priority to European Application No. 20472018.9, filed Dec. 17, 2020. The priority application, EP 20472018.9, is hereby incorporated by reference in its entirety.

FIELD OF THE INVENTION

The invention relates to an autonomous device for moving above the water surface, part of the device being under water and another part being extended above the water surface at a specified height.

BACKGROUND OF THE INVENTION

The devices for walking over the water have applications in the field of entertainment services and sports. They usually use the physical force of the person who uses them for propulsion, the mechanical force of a motor or engine (powered by one of the known ways, such as using internal combustion), which provides the movement or so-called lifting force.

There are known devices for moving in a fluid, which are driven by a motor (by burning some kind of fuel or powered by electricity), which moves 2 propellers, allowing the lifting of a person standing on a platform—U.S. Pat. No. 2,953,321A. In the specific example, the fluid is air, and the device allows vertical take-off and landing, as well as movement in a horizontal direction. The direction is determined (set) by the position of the person on the platform—to which side more pressure is applied or how the balance of the platform (by the person/pilot) has changed, in which position the pilot has leaned. Lifting or lowering is done with the two propellers, which rotate in opposite directions, around which there is a frame. The rotation of the two propellers in opposite directions achieves a balance of forces and the aircraft does not rotate in any direction vertically (if the propellers rotate at the same speed).

The disadvantage is that when taking off you have to use more energy (fuel) precisely because the tanks are full of fuel and they add extra weight to that of the pilot and the structure itself. Another disadvantage is the large overall dimensions of the whole device, the inefficiency of the internal combustion engine, as well as the complex design of the aircraft.

Another known embodiment for moving a person in a fluid is the use of a system of platform and devices providing vertical traction positioned on the periphery of the platform. The system generates thrust with the corresponding force in a direction perpendicular to the plane of the platform on which the person is positioned—US2020023971A1. The thrust generating system may comprise more than one propeller, where the propellers operate in a specific sequence (synchrony) to provide the required total thrust for vertical lifting (take-off) of the device. A disadvantage of this type of system (and all reviewed in previous inventions of the same type) is that it does not provide the ability to move in the fluid with a higher density—for example water.

Their shape will create a large hydrodynamic resistance, and also the propellers themselves must have a different design, consistent with the fluid in which they will be (used).

A third implementation that is known to move in a fluid are the hydrofoils driven by an electric motor powered by a constant battery voltage (WO2019050570 A1, CN209366405U, WO2019104379A1, and U.S. Pat. No. 9,359,044B2). These devices are used for sports and entertainment in water and comprise mainly of a platform (on which the user/person steps), which when moving rises above the water surface; mast—part of it is in the water and above it, on which the platform is mounted; hydrofoil or wing system—providing the necessary angle of attack to generate lift; an electric motor powered by a constant energy provided by a battery placed in a selected part of the whole device, but usually in the platform. With this type of device, the lift is generated by the combination of electric motor and hydrofoil, as in airplanes. The convenience is that when moving the platform it is raised above the water, and this rise can be controlled by the user of the hydrofoil. In this way, the movement is free of "turbulence" caused by the splashing of the waves, compared to an ordinary surfboard moving on the water surface, not above it. The disadvantage is that the movement is only one-way-forward, it can turn, but not move in all directions, for example, in the opposite direction or sideways without turning, as in the air device US2020023971A1. The rise above the water surface cannot be done vertically, but is done progressively in one direction.

SUMMARY OF THE INVENTION

It is an object of the present invention to provide a water vehicle allowing vertical lifting of a platform above the water surface so that it can move in all directions in a fluid with a higher density than air, for example water. The device needs to have a small resistance when moving in the fluid, which requires part of it to be above the water surface (the platform on which the person will step), and another part, providing buoyancy in all directions—below the water surface.

This and other tasks are solved by creating a water vehicle comprising of an underwater propulsion module, an upper platform and a vertical connecting support fixed at both ends for the propulsion module and for the upper platform, power source and electronic control unit. According to the invention, the propulsion module comprises of a housing in which at least two propeller groups are mounted, each of which comprises an electric motor and water screw propellers with two to five blades, the propeller groups being arranged symmetrically with respect to the central vertical axis of the housing and are designed to generate vertical thrust such that the upper platform (1) plus maximum payload be lifted above the water surface. Rotational axes of the propeller groups are arranged vertical or at an angle to the central vertical axis of the housing.

Preferably the propeller groups are at least four.

In a preferred embodiment, the propulsion module housing is a convex, streamlined profile with rotational symmetry relative to the central vertical axis of the housing, each propeller group is mounted in a tunnel in the propulsion module housing. Preferably, the tunnels of the propeller groups are vertical.

It is advantageous if the propeller groups comprise BLDC electric motors which are controlled by pulse width modulation.

Preferably, the water screw propellers have a constant pitch.

It is advantageous if the power source and the electronic control unit are mounted in the housing of the underwater propulsion module. This arrangement provides greater stability of the device.

In a preferred embodiment, the water vehicle also comprises a sensor unit for orientation and positioning comprising one or more of the following devices: a gyroscope, ultrasonic distance sensors, a GPS module and/or an accelerometer. The sensor unit provides data to the electronic control unit for the location of the water vehicle in space.

Preferably, the device also comprises a communication module and a remote control.

It is advantageous if the upper platform has a positive buoyancy that is greater than the total negative buoyancy of the other structural elements plus the maximum payload. This allows the device to be held above the water together with the user when the motors are not running.

A water vehicle according to the invention can move equally well in all directions, unlike existing water vehicles of this type. The vehicle is very maneuverable, safe and easy to drive and allows the user to make unlimited movements and "soft" and "smooth" movement in the water (fluid), overcoming the splashes of waves in more turbulent waters or in the event of sudden wind which creates waves.

BRIEF DESCRIPTION OF THE FIGURES

Hereinafter, the water vehicle subject of the invention is explained by preferred embodiments, given as non-exhaustive examples, with reference to the accompanying figures, where:

FIG. 4 is a schematic axial view of another embodiment of the device, in which a vertical support for the user is mounted on the upper platform.

FIG. 5 is a schematic bottom axial view of the embodiment of FIG. 4.

FIG. 6 is an enlarged view of the upper platform in which the batteries and the electronic control unit of the device are placed.

FIG. 7 is an enlarged view of the underwater propulsion module, in the housing of which are placed the batteries and the electronic control unit of the device.

EXAMPLES OF EMBODIMENT AND OPERATION OF THE INVENTION

The water vehicle (device) according to the invention comprises:

- an upper platform 1, intended to carry the person (user of the device), which before and during start-up of the device floats on the water surface, and after starting of the device, as a result of the created lifting force rises to a certain distance above the water;
- an underwater propulsion module comprising at least four electric motors 4 designed to create a vertical thrust for lifting the upper platform above the water and to move the vehicle in different directions;
- a vertical support 3, representing a mast or pylon, which serves as a rigid connection between the upper platform 1 and the propulsion module, where usually the upper end of the vertical support 3 is mounted stationary to the lower surface of the upper platform 1, and its lower end is mounted, respectively, to the upper surface of the propulsion module;
- electronic control unit;
- power supply unit.

Figures 1, 2, 3:
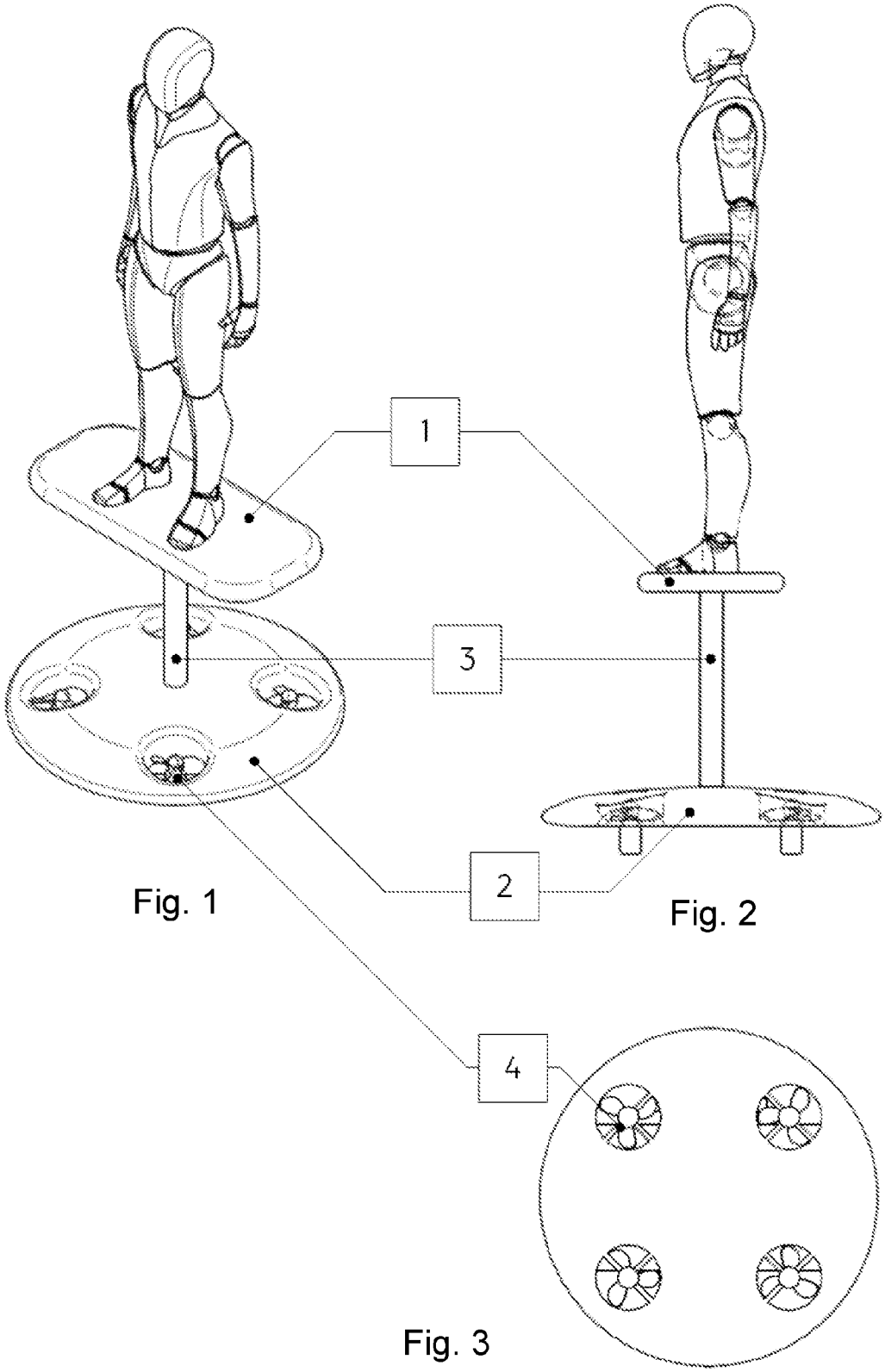
FIG. 1 is a schematic axial view of one embodiment of the device with a user depicted.
FIG. 2 is a schematic side view of the device of FIG. 1.
FIG. 3 is a schematic bottom view of the device of FIG. 1.
Figure 8:
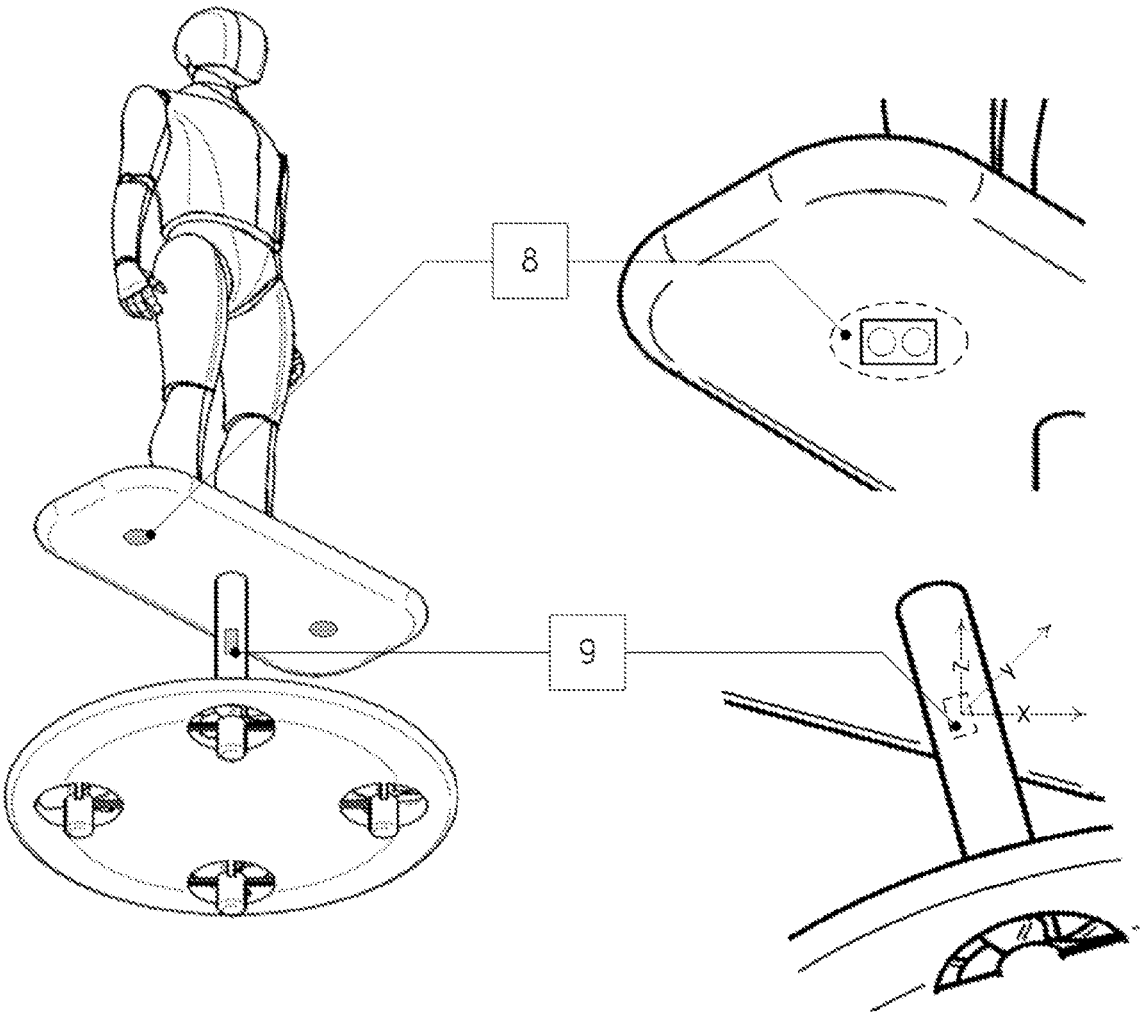
FIG. 8 is a schematic bottom axial view of the device of FIG. 1 with indicated positioning sensors and in enlarged images.

The upper platform 1 can be made as a surfboard of known suitable materials, such as expanded polystyrene (expanded polystyrene—EPS), expanded polypropylene (expanded polypropylene—EPP), impregnated plywood and others, and can also be made of any of the listed materials in combination with carbon fibres applied by a corresponding known method. In addition to the above-mentioned shape, the upper platform can also be of any other suitable shape, for example, round or rectangular (as shown in the figures). Preferably, one or more places for stepping on are provided on the upper surface of the upper platform. In the embodiment shown in the figures, the entire upper surface of the upper platform is flat and suitable for stepping. It is recommended that this upper surface be made of a certain non-slip material. For greater user stability, the upper platform may have various supports 5, handles, stands and other devices (FIG. 4). It is possible to have a seat on the upper platform, so that the user of the device can ride while sitting. Also, additional elements of the device such as electronic control unit 6, batteries 7, sensors and others can be mounted in the upper platform (FIGS. 6 and 8).

The upper platform 1 must have a positive buoyancy sufficient to ensure that the whole device is floating on the water together with the payload (in this case a person) when the device is not operating.

The underwater propulsion module comprises of a housing 2 with propeller groups 4 mounted on it, each of which comprises an electric motor and water screw propellers. The propeller groups 4 in the preferred embodiment given in the figures are four. The underwater propulsion module must be of neutral or low-negative buoyancy so that it sinks into the water. The rotational axes of the propeller groups 4 are vertical or are arranged at an angle to the central vertical axis of the housing 2.

The housing 2 of the propulsion module may be a convex streamlined profile with a rotational symmetry relative to the central vertical axis of the housing, in order to minimize the resistance when moving in an aqueous medium. In addition, the convex streamlined profile of the housing helps to create additional lift during underwater movement, and the symmetrical shape of the housing allows additional lift to be generated when the device moves in any direction. This use of hydrodynamic forces allows the installation to be partially unloaded during movement and energy savings can be achieved. The streamlined profile can be solid or hollow and waterproof. In this embodiment, the housing can be made, for example, of expanded polystyrene (EPS), expanded polypropylene (EPP), impregnated plywood, reinforced carbon fibre or polymer and others. It is also possible to combine the above with carbon fibres, applied by a corresponding known method.

If the housing is hollow, various elements of the device can be accommodated in it, such as electronic control unit 6, batteries 7, communication unit and others. Said elements can also be arranged in a solid profile, providing watertight cavities for accommodating these elements. Accommodating all or part of said elements in the underwater propulsion module is advantageous, thus achieving a balance with the upper platform and positioned thereon user. The streamlined profile viewed from above can be round, elliptical, oval or other symmetrical shape. In cross-section through the central vertical axis, the housing may be in the form of part of a circle or other complex arcuate shape, which ensures the fluidity of the profile. Preferably, the opposite ends of the housing are uniformly rounded, which allows the streamlined module to move in all directions and generate lift. Preferably, the bottom surface of the housing is flat and substantially horizontal. It is also possible that the bottom surface of the housing is convex. The propeller groups 4 in such a housing are mounted in open tunnels or through holes in the housing. The tunnels can be arranged vertically, but can also be arranged at an angle to the vertical axis of the housing, directing the water jet and helping to create traction.

A housing that is a frame is also possible to which the propeller groups are mounted stationary or with the possibility for different positioning. The frame can be made of carbon fibres/fibres, reinforced polymer, aluminium and other lightweight materials, as well as a combination of them with carbon fibres/fibres. Accordingly, in this embodiment as well, the propeller groups may be arranged in tubes (tunnels), which may be arranged vertically or inclined. It is possible for the tubes with the propeller groups to be mounted movably to the frame and with additional electric motors, for example, to tilt or stand in relation to the vertical axis of the housing, thus determining and changing the direction of movement of the device. A watertight container containing, for example, the electronic control unit, the power source (batteries) and the communication unit may also be mounted to the frame of the housing symmetrically on the vertical axis.

The arrangement of the propeller groups 4 in relation to the vertical axis of the propulsion module housing must be symmetrical. It is possible for the propeller groups 4 to be evenly distributed at equal angular distances from each other. It is possible to arrange them in groups, for example two by two, when they are an even number, relative to a vertical plane of symmetry. The optimal number of propeller groups is four, but can be two, three, five, six or more. The larger number allows more precise control of the device, but at the same time leads to complexity and aggravation of the structure.

Since the device is designed to move in an aqueous environment, the propeller groups 4 comprise water screw propellers, which transform the mechanical energy from the electric motors into a propulsion thrust. The propellers are structurally positioned so that the thrust created by them is directed vertically. The propellers can have a different number of blades (from two to five). Preferably, the propellers are standard water screw propellers with a constant pitch along the entire length without controlling the blades themselves. In this embodiment, the thrust is controlled by changing the rotational speed of the electric motors, i.e. with frequency control. This simplifies the design and control system of the device.

In a preferred embodiment, the propeller groups 4 comprise BLDC electric motors that are controlled by pulse width modulation by a PWM (pulse width modulation) controller. The motor controlled by constant electricity can be of another type, for example, of the brushed type.

The vertical support 3 connecting the two modules, underwater and above water, has an aerodynamic cross section and may be hollow or solid tube. The material from which the vertical support 3 can be made is, for example, polycarbonate, aluminium, carbon fibres or a combination of the above. The hollow tube may contain electrical or communication wires, and connecting elements placed in the two modules. For example, if the electronic control unit 6 is in the upper platform 1, the wires connecting it to the propeller groups 4 are placed in the tube. The cross section of the connecting tube is in accordance with the loads in the structure in order to ensure the required strength. Preferably the shape of the vertical support 3 is cylindrical. Sensors and other elements of the device may be mounted on the vertical support.

In a preferred embodiment the vertical support is transparent, creating a visual effect of flying above the water surface.

As an energy source in the power supply unit, lithium-ion battery cells are preferably used, connected in parallel and/or in series so as to form a battery pack, but they can be any other battery sources. For example, batteries can be used to be integrated into the very structure of one of the elements of the device, such as a conformal battery placed in the vertical support.

The device has an electronic control unit 6, comprising a microprocessor with control logic performing logical and arithmetic operations on the basis of which it controls the electric motors. The electronic control unit can be placed both in the upper platform and in the underwater propulsion module. It is possible that the different modules of the electronic control unit to be placed in different parts of the device and to be wired or wirelessly connected to each other. For example, the main part of the electronic control unit may be placed in the upper platform, and the electronic speed controller (ESC) module may be placed in the underwater propulsion module. The electronic control unit is connected to various sensors for receiving information about the position and speed of the device, to the propeller groups for supplying control signals to the electric motors, to the power supply unit for monitoring the battery charge level, and to other units of the device.

In a preferred embodiment, the device has a sensor unit for orientation and positioning, which may comprise gyroscopes, ultrasonic distance sensors, a GPS module, an accelerometer and/or other sensors. The sensors of the sensor unit are connected to the electronic control unit and provide it with data on the position of the device in space, which data is used in the algorithms of the electronic control unit to determine the commands to the propeller groups.

To stabilize the device under and above the water surface, as well as to maintain a certain (set) height above the water surface, sensors (electromechanical sensors) are used—gyroscopes 9 and ultrasonic distance sensors 8. The gyroscopic sensor 9 determines whether the device, respectively the upper platform has an incline, and the ultrasonic distance sensor 8 determines whether and how much the device has risen above the water surface. In this way, the device is stabilized by relevant calculations and generated by electrical pulses (signals) to the propellers, ensuring that it does not rise too high above the water surface or that it does not roll over.

The device may have a communication module. It serves to provide a wired or, preferably, wireless medium for data transmission (command exchange) between the units of the water vehicle—for example between the electronic control unit and the remote control or between the electronic control unit and another device supporting the same standard for wireless communication, or between different modules of the electronic control unit and other unit (s) comprising the device. An example of another device may be a mobile phone of the user of the water device with installed in advance user application, which can read data from the water vehicle or settings (with commands that are being sent) from the user application to the water vehicle. The communication module can be any wired or wireless (preferably) known—GSM/GPRS module, Wi-Fi module, and Bluetooth (Bluetooth Low Energy-BLE) module, a combination of the above or another type.

Device Operation

The control of the movement of the device can be performed by changing the center of gravity by the person and/or by remote control and/or control lever. The resulting inclination of the underwater propulsion module sets the direction of movement, and the magnitude of the inclination determines the forward speed.

The dynamic model of the device is similar to the modelling of the classic inverted pendulum control problem. The aim is to keep the device always upright in an unstable equilibrium position. The balancing process is provided by one or more computing units running their own software, which are part of the electronic control unit, gyroscopic tilt sensors and accelerometers to determine the position of the platform. Frequency-controlled motors rotate the propellers at variable speeds as needed for balance or movement. For proper functioning, the electronic control unit of the device has the necessary powerful microprocessors to process the information coming from the gyroscopic tilt sensors, accelerometers and other sensors. The device also comprises systems that determine in real time the location of the center of gravity and can quickly process the incoming information. Thus, the device automatically balances whether a person is moving on the platform or simply standing up. In the process of driving, the driver maintains the desired speed by changing the incline and transferring his weight forward, backward and sideways. The direction of inclination also determines the direction of movement. The speed of movement in a given direction depends on the magnitude of the inclination of the device caused by the displacement of the controller relative to the surface platform. The speed with which the incline changes practically determines the acceleration of movement. At zero speed and fully upright position, it is possible for the water device to turn in place, as a command to do so is given by a side swing with an outstretched hand. This causes rotation relative to the vertical axis caused by the moment of inertia of the human body on the platform.

The device can be controlled by changing the speed of the motors, respectively the propellers, which also changes the thrust generated by the propeller group. Changing the thrust of each motor creates a change in the application point of the resulting vector of the total thrust generated by all motors. This creates inclines of the entire mechanical system and vector components in the horizontal direction, causing the horizontal movement of the device.

Vertical Movement

The device uses water screw propellers for movement and control. The rotating blades of the propeller are pushing the water down. All forces are in equilibrium, which means that while the propeller pushes the water, the water in turn pushes the propeller in the opposite direction. The faster the propeller turn, the greater the lifting force and vice versa. Thus, the device can do three things in the vertical plane: to keep a level, to ascend (rise) or descend, To keep the platform at a certain level above the water, the net thrust of the four or more propellers lifting the device upwards must be equal to the gravitational force plus the buoyancy force of the underwater part. If the water vehicle has to be raised, the thrust of the propellers simply increases, which is equivalent to an increase in their rotation speed. Thus, the thrust becomes greater, i.e. there is a nonzero upward force that is greater than the weight. Then the thrust can be slightly reduced until a new equilibrium is reached. The descent requires the exact opposite to be done: the thrust (revolutions) of the propellers is reduced so that the resulting force is downwards.

Rotation

In order to be able to rotate relative to the vertical axis of the device in question, it is necessary to implement a drive scheme in which each pair of opposing propellers rotate in one direction, but separately the pairs rotate in opposite directions. If, for example, a scheme with four motors (propellers) is considered, then in this configuration two opposing propellers rotate counter clockwise and the other two rotate clockwise. With the two pairs of propellers rotating in opposite directions, the total angular momentum is zero. If no torque is applied to the system, then the total angular torque must remain constant (in this case zero). In order to clarify the mechanism of rotation, it is necessary to take into account impact of the inertial moments of the propellers and the reactive moments acting on their blades. Assume that the device must rotate to the right. In this case, the propellers, which rotates clockwise, should reduce the speed of rotation. This action, however, leads to a disturbance of the balance of forces in the vertical. To avoid this problem, it is sufficient to increase the rotational speed of the counter clockwise propellers to the degree that compensates for the loss of lift from the other reduced angular velocity of the other pair of propellers. The angular torque of the propellers is no longer zero, so the body of the device must rotate. But the total vertical force remains equal to the gravitational force and the device remains at the same vertical level. Because the pairs of propellers are diagonally opposite to each other, the device can still remain in balance in the forward and sideways directions.

Progressive Movement

In essence, there is no difference between moving forward or backward, as well as on the sides, because the arrangement of the motors and propellers is symmetrical. This means that the explanation of how to move the device forward or backward is the same as moving in one of the lateral directions. Forward movement requires a thrust component of the propellers also directed forward. This can be achieved by increasing the speed of rotation of the propellers in the rear position of the device, relative to the direction of movement and reducing the speed of the propellers from the front relative to the direction of movement. The total thrust will remain equal to the weight, so the device will remain at the same vertical level. Also, since one of the rear propellers rotates counter clockwise and the other clockwise, the increased rotation of these propellers still retains zero angular torque. The same applies to the front propellers and so the device does not rotate relative to the vertical axis. However, the greater force at the back of the device means that it will tilt forward. A slight increase in thrust for all propellers will result in a net thrust force that has a weight balancing component along with a forward motion component.

An additional control option in the embodiment in which the propeller group can rotate relative to the housing frame is to change the inclination of the propeller groups relative to the vertical axis of the housing. In this embodiment, the construction of the considered water device allows rotation of the gondolas in which the propeller groups are arranged relative to the horizontal axis. Such a variant allows control of the thrust vector of each gondola separately. Here, as in the previous scheme, the inclination of the propellers will lead to a reduction in lift force, and this must be compensated by increasing the speed to maintain balance along the vertical axis. In fact, the vertical movement will be controlled only by a change in speed, respectively the thrust generated by the propellers. The movement forward, backward and sideways, as well as the rotation around the vertical axis will be provided by the rotation of the motor gondolas, leading to a change in the thrust vector. These angular displacements must be performed according to a well-defined algorithm and opposite pairs to ensure proper targeting of the device.

The reference numbers of the technical features are included in the claims only for the purpose of increasing the comprehensibility of the claims and, therefore, these reference numbers have no limiting effect on the interpretation of the elements indicated by these reference numbers.

The invention claimed is:

1. A water vehicle comprising an underwater propulsion module, an upper platform and a vertical support, in the form of a mast or a pylon, connecting and fixed at both ends to the propulsion module and to the upper platform, an energy source and an electronic control unit, the propulsion module having a housing in which at least two propeller groups are mounted, each of which comprising an electric motor and a water screw propeller with two to five blades, wherein the propeller groups are arranged symmetrically with respect to the central vertical axis of the housing and are designed in working state to generate vertical thrust such that the upper platform plus maximum payload to be lifted above the water surface, wherein rotational axes of the propeller groups are arranged vertically or at an angle to the central vertical axis of the housing, the housing of the propulsion module having a convex streamlined profile with rotational symmetry with respect to the central vertical axis of the housing, each propeller group being mounted in a tunnel in the housing of the propulsion module.

2. The water vehicle according to claim 1, wherein there are at least four of the propeller groups.

3. The water vehicle according to claim 1, the tunnels of the propeller groups being vertical.

4. The water vehicle according to claim 1, the propeller groups comprising BLDC electric motors which are controlled by pulse width modulation.

5. The water vehicle according to claim 1, the water screw propellers have a constant pitch.

6. The water vehicle according to claim 1, the energy source and the electronic control unit being mounted in the housing of the underwater propulsion module.

7. The water vehicle according to claim 1, further including a sensor unit for orientation and positioning comprising one or more of the following devices: ultrasonic distance sensors, a gyroscope, a GPS module and/or an accelerometer.

8. The water vehicle according to claim 1, further comprising a communication module and a remote control.

9. The water vehicle according to claim 1, the upper platform having a positive buoyancy which is greater than the total negative buoyancy of the other structural elements plus the maximum payload.

* * * * *